US005318259A

United States Patent [19]

Fussler

[11] Patent Number: 5,318,259

[45] Date of Patent: Jun. 7, 1994

[54] COLUMN ADAPTED TO BE USED IN A MODULAR CONSTRUCTION SYSTEM

[75] Inventor: Philippe Fussler, Strasbourg, France

[73] Assignee: Steelcase Strafor (S.A.), Strasbourg, France

[21] Appl. No.: 918,059

[22] Filed: Jul. 24, 1992

[30] Foreign Application Priority Data

Nov. 21, 1991 [EP] European Pat. Off. ..... 91440098.1

[51] Int. Cl.[5] ..... A47B 91/00

[52] U.S. Cl. ..... 248/188.8; 108/50; 248/218.4; 312/223.6

[58] Field of Search ..... 248/188.8, 188, 218.4; 312/223.6, 194, 196; 108/50, 106, 108

[56] References Cited

U.S. PATENT DOCUMENTS

| | | | |
|---|---|---|---|
| 2,935,210 | 5/1960 | Cohen | 108/106 |
| 3,132,609 | 5/1964 | Chesley | 108/106 |
| 4,284,840 | 8/1981 | Baker | 248/218.4 |
| 4,296,981 | 10/1981 | Hildebrandt et al. | 312/194 |
| 4,535,703 | 8/1985 | Henriott et al. | 108/50 |
| 4,592,602 | 6/1986 | Kuster et al. | 312/223.6 |
| 5,121,698 | 6/1992 | Kelley | 108/50 |
| 5,144,896 | 9/1992 | Fortsch | 108/50 |
| 5,160,188 | 11/1992 | Rorke et al. | 312/223.6 |
| 5,253,595 | 10/1993 | Heidmann | 108/157 |

FOREIGN PATENT DOCUMENTS

| | | |
|---|---|---|
| 504533A1 | 9/1992 | European Pat. Off. . |
| 8618208 | 8/1986 | Fed. Rep. of Germany . |
| 3603465 | 8/1987 | Fed. Rep. of Germany . |
| 9002294 | 5/1990 | Fed. Rep. of Germany . |
| 2655251 | 6/1991 | France . |

*Primary Examiner*—Richard K. Seidel
*Assistant Examiner*—Hwei-Siu Payer
*Attorney, Agent, or Firm*—Mason, Fenwick & Lawrence

[57] ABSTRACT

A column adapted to be used in a modular construction system for office furniture, comprises a lower portion configured to support a horizontal working surface of the modular construction system and defines a guiding channel for guiding wires connected to electrical apparatus received on the horizontal working surface, and an upper portion positioned above and extending beyond the lower portion and defines a guiding channel for the wires connected to the electrical apparatus. A pair of adjoining vertical walls of the upper portion define a rear corner. The vertical walls have vertical edges which have grooves therein. A connector block is slidably movable in the rear corner of the upper portion. The connector block has a plurality of electrical connectors mounted therein as an assembly. The connector block is selectively removable at will. A vertical front face is slidably mounted along the grooves in a vertical edges of the vertical walls.

11 Claims, 4 Drawing Sheets

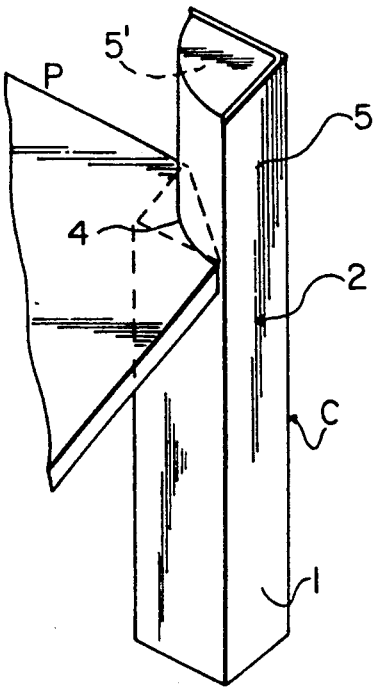
FIG. 1
PRIOR ART
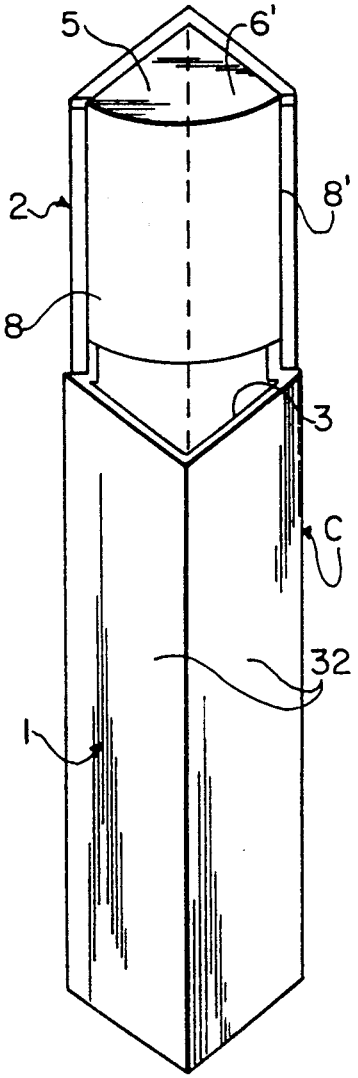
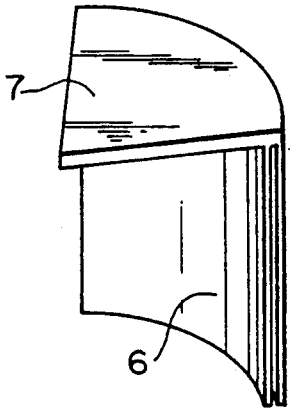
FIG. 2a
PRIOR ART
FIG. 2
PRIOR ART

COLUMN ADAPTED TO BE USED IN A MODULAR CONSTRUCTION SYSTEM

This invention relates to new and useful improvements in the modular construction systems for office furnitures, such as described in the EP-A-91440021.3 of the applicant. The invention is more specially directed to the guiding and connecting means for the electric wires feeding all appliances and apparatuses received on a working surface such as computers, telephones, lamps and the same.

The problem with such systems comes from the multiplicity of such apparatuses and appliances which are distributed on a comparatively restricted area with their individual connections, with a chance of mixing up of such connections between separate area on the same surface.

A solution to this problem has been proposed in U.S. Pat. No. 4,535,703, in which the various wires are horizontally guided within plastic sections mounted between the working surface periphery and the walls against which is built said working surface.

Another solution is proposed in the F-A-89 16085 of the Applicant, in which each of said wires is guided from the ground until the closest point of the corresponding apparatus, by a series of metal sections which form together the supporting frame of said working surface.

This invention proposes a quite new solution to this problem by using one of the standard elements of a modular system for office furniture as described n the above EP-A-91440021.3, for providing at the working surface level a movable common connector for all needed connections, easy to reach without affecting the aesthetics of said element.

The standard element referred to is the column as described in EP-A-91440021.3 and provided to be used, as far a lower portion thereof is concerned, as a rest for an angle of the plate used as a working surface in the system, and as far an upper portion thereof is concerned, as an access to a movable connector between the wires guided within the whole height of said element and all apparatus distributed on said working surface.

Generally speaking, such connectors are known, but merely mounted on a front face of an element of office furniture, that is fixed and constantly visible.

According to the invention, in said column, the vertical front face of the upper portion, preferably in one piece with the horizontal cover of the column top, is slidably mounted along vertical grooves provided along the front edges of the upper portion walls, whereas all connectors are mounted as a connector block vertically sliding in the rear internal angle of the column so that it can be easily removed to be modified, repaired or replaced depending on the number and nature of said connections.

In addition thereto, the lower portion of the column is equipped with a front opening providing an easy access to all wires guided within the column and covered with a movable wall.

The invention will now be described in detail with reference to the attached drawing, in which:

FIG. 1 shows an angle of an office desk comprising a column as described in the EP-A-91440021.3 cited above, as modified in accordance with a first embodiment of the invention.

FIG. 2 is a front view of the column above, the front face of the upper portion being removed and shown on FIG. 2*a*.

FIG. 2*a* shows a sliding cover comprising a front wall and a cover.

Figure 3:
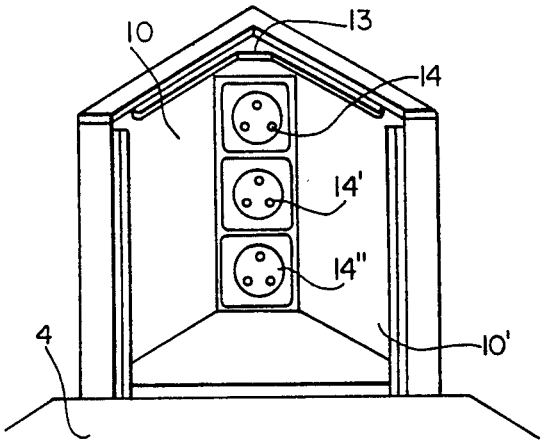

FIG. 3 shows a front view of a first modification of the invention, the upper front wall being removed, with the connecting block in place.

Figure 4:
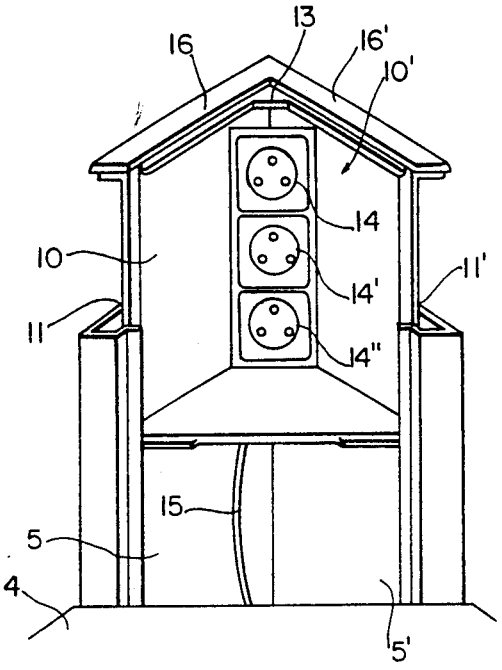

FIG. 4 is similar to FIG. 3, with the connecting block being removed.

Figure 5:
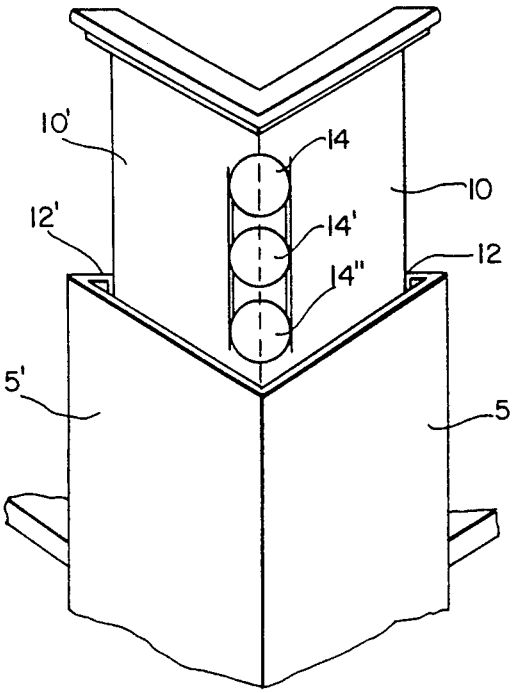

FIG. 5 is similar to FIG. 4, from the rear.

Figure 6:
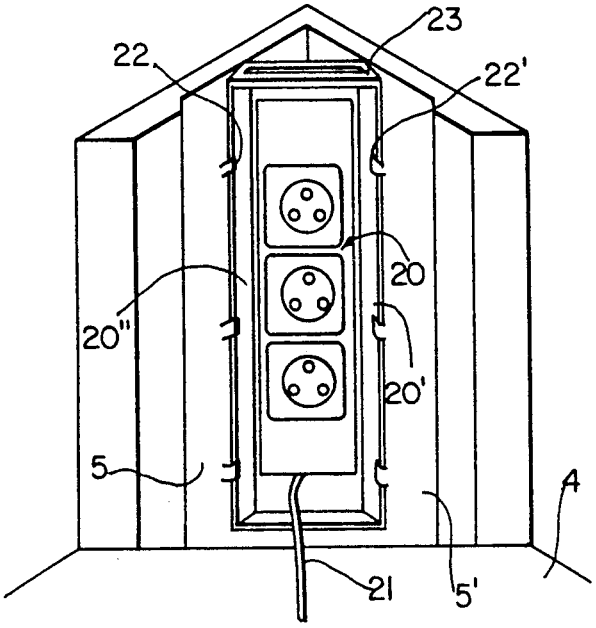

FIG. 6 shows a front view of a second embodiment of the invention, the connecting block in place.

Figure 7:
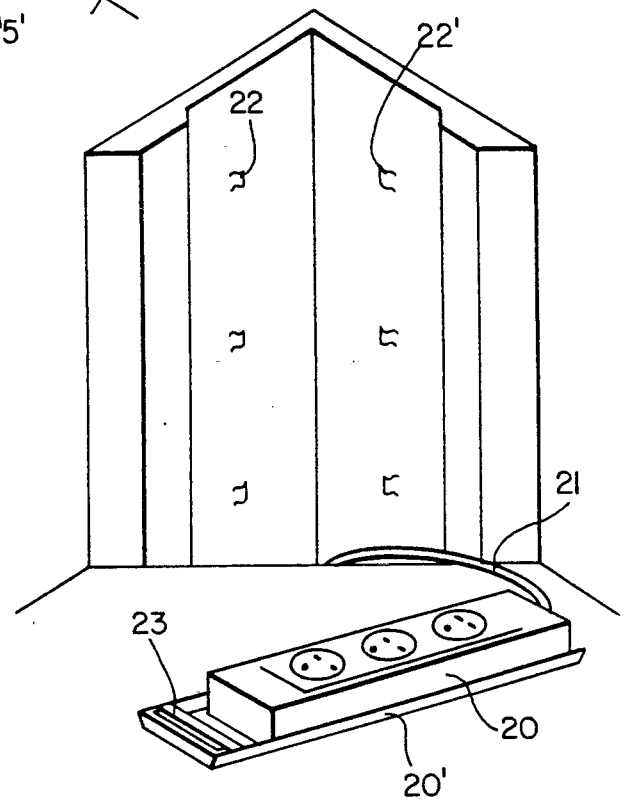

FIG. 7 is similar to FIG. 6, the connecting block removed.

Figure 8:
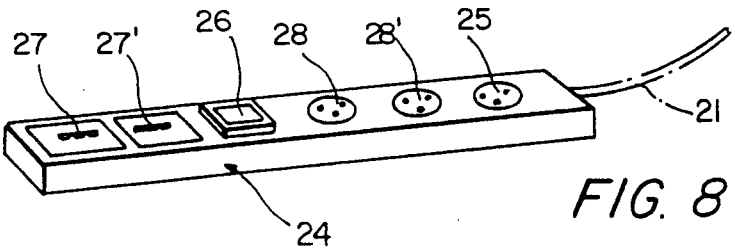

FIG. 8 is a modification of the connecting block of FIG. 6–7, and

Figure 9:
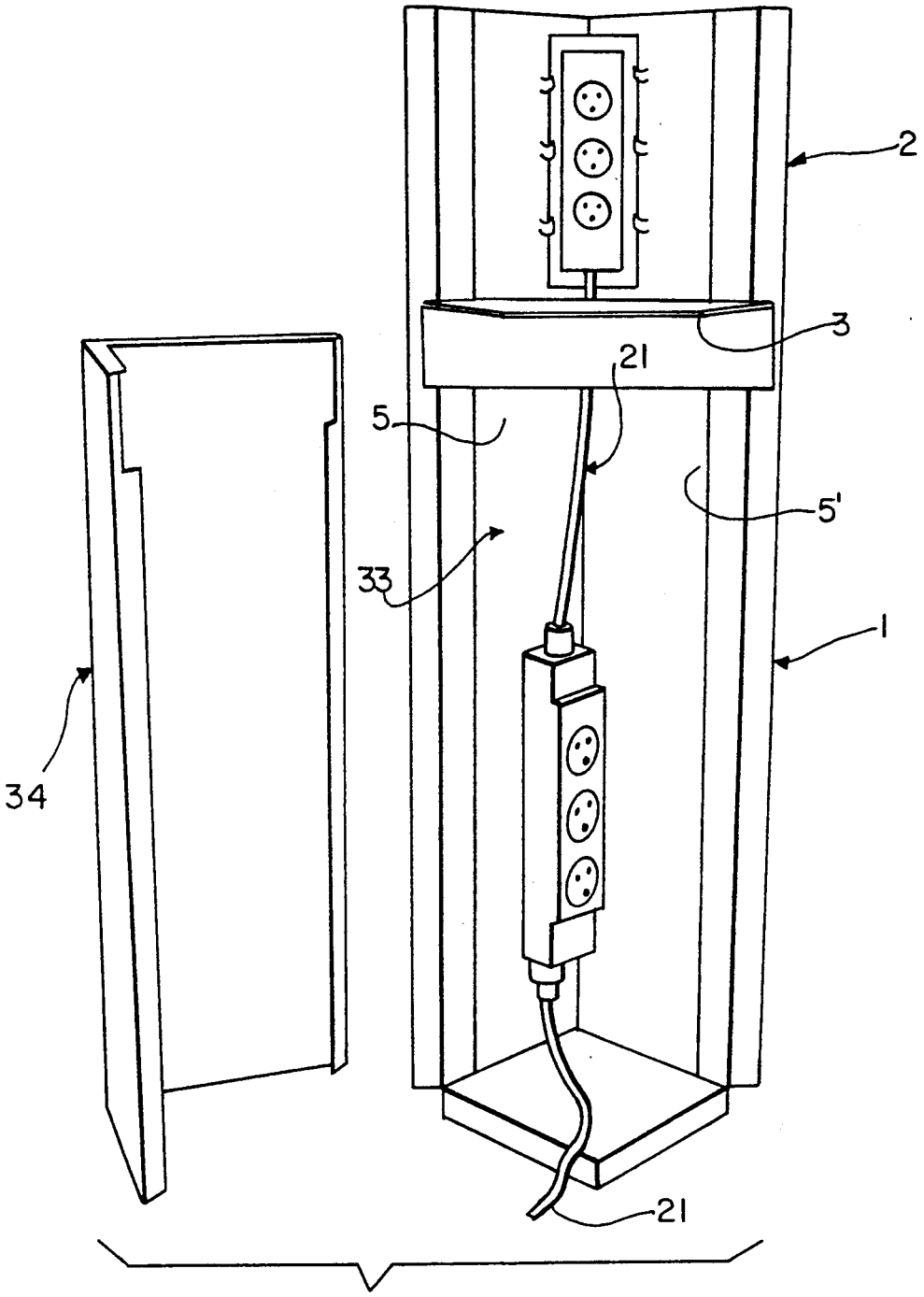

FIG. 9 shows the lower portion of the column, the front opening cover being partially removed.

As shown on FIG. 1 and 2/2*a*, the invention relates to a column C comprising a lower portion 1 of square section and an upper portion 2 of triangular section, connected along a horizontal section comprising a triangular open face 3 used as a rest for an angle 4 of a working plate P in a known manner.

According to the invention, the column C comprises along its whole height a couple of fixed rear walls 5,5' and along the height of its lower portion of a couple of front walls shown as 32 on FIG. 2, and which will be described more in detail thereafter. Above section 3, the front portion of the upper portion is closed by a sliding cover (FIG. 2*a*) comprising a front wall 6 and a cover 7. Said cover slides vertically in vertical grooves 8,8' provided in the front vertical edges of walls 5,5', so that, in place, said cover is completely closing the inner space of the upper portion 2. Said front wall 6 and cover 7 can advantageously be decorated preferably in the same manner as the front of the boxes on which the plate P rests (not shown).

According to the invention, said inner space is provided with means to accommodate a connection block slidably mounted therein to be removed as needed to change or repair all connectors guided within column C to feed all appliances received on plate P.

FIGS. 3, 4 and 5 show a first modification of such a connecting block. In this modification the block comprises two vertical wings 10,10' slidably mounted close to walls 5,5' and the front edges 11,11' thereof are guided in vertical grooves 12, 12' provided in faces 5,5' behind grooves 8,8'. In the vertical corner 13 of wings 10,10' are provided connectors 14,14', 14'' adapted to the appliances received on plate P and fed from corresponding wires 15 guided within column C from the base thereof.

In this construction, the block can easily be removed as an assembly with wings 10,10', with the assistance of horizontal rims 16,16', which can easily be reached when the cover 2*a* is removed.

FIG. 6 and 7 show a different modification in which the wings 10,10' are omitted. In this case, the block 20 is similar to a common multiple connector fed by the wires 21. Instead of being in one piece with a removable portion as 10,10', the block 20 is itself equipped with lateral oblique edges 20',20'' engaging punched hooks 22,22' provided on the internal face of walls 5,5'.

It is easy to have the block placed in and removed from the column upper portion 2 by sliding the edges 20', 20'' under the hooks 22,22', with the help of a handle 23.

In this second modification, an advantage of the block 20 to be free to move regardless of a movable outfit such as wings 10,10' is the possibility to build it in any dimension to accommodate a number of various connections, such as telephones (27,27'), computers (26), a HT connection (25), common connections (28,28'), as shown in a block 24 on FIG. 8. Such a connecting block can even have the whole height of column C.

Finally FIG. 9 shows a preferable modification of the lower portion 1 of column C, in which are wires are accessible under table P.

In this modification the vertical front part 32 of the lower portion 1 is formed with an open window 33 through which the user can reach all wires 21 and the same to perform all operations of drawing, control, repairing, change and the same.

Said window 33 can be closed by a movable panel 34 as shown or by a door hinged upon one vertical edge, or by any closing means.

It should be noted that such a window 3 is opening towards the internal space of the element such as a desk, i.e towards the user. In such a way, it is possible to associate several similar elements by juxtaposing their respective columns, the rear face thereof only being affected, which leaves the front face free to open.

It is well understood that the invention is not limited to the described modifications which are only given as illustration examples.

I claim:

1. A column adapted to be used in a modular construction system for office furniture which includes a horizontal element forming a working surface, comprising:

a lower portion configured to support the horizontal working surface of the modular construction system and defining a guiding channel for guiding wires connected to electrical apparatus received on the horizontal working surface;

an upper portion positioned above and extending beyond said lower portion and defining a guiding channel for the wires connected to the electrical apparatus, said upper portion including a pair of adjoining vertical walls defining a rear corner of said upper portion, said vertical walls having vertical edges, said vertical edges having grooves therein;

a connector block slidably movable in said rear corner of said upper portion, said connector block having mounted therein a plurality of electrical connectors, said connector block being selectively removable at will; and a vertical front face slidably mounted along said grooves in said vertical edges of said vertical walls.

2. The column of claim 1, wherein said lower portion is a vertical prism having a square-shaped cross-section, said upper portion is a vertical prism having a triangular-shaped cross-section, and said connector block is slidably mounted in said vertical edges of said vertical walls of said triangular portion.

3. The column of claim 2, wherein said connector block is fixed in a pair of adjoining vertical wings, said wings covering said vertical walls of said upper portion and being slidably movable along said grooves in said vertical edges of said vertical walls.

4. The column of claim 3, wherein said lower portion has front walls, said front walls of said lower portion being formed with an opening providing access to the connectors and a movable cover closing said opening.

5. The column of claim 2, wherein said connector block has vertical edges removably mounted on said vertical walls by hooks.

6. The column of claim 5, wherein said lower portion has front walls, said front walls of said lower portion being formed with an opening providing access to the connectors and a movable cover closing said opening.

7. The column of claim 2, wherein said lower portion has front walls, said front walls being formed with an opening providing access to the connectors and a movable cover closing said opening.

8. The column of claim 1, wherein said connector block has the same height as said column.

9. The column of claim 8, wherein said lower portion has front walls, said front walls of said lower portion being formed with an opening providing access to the connectors and a movable cover closing said opening.

10. The column of claim 1, wherein said lower portion has front walls, said front walls being formed with an opening providing access to the connectors and closed by a moveable cover.

11. The column of claim 10, wherein said opening faces outwardly.

* * * * *